US008789860B2

(12) United States Patent
Beck et al.

(10) Patent No.: US 8,789,860 B2
(45) Date of Patent: Jul. 29, 2014

(54) REINFORCED MOTOR VEHICLE LOCK

(75) Inventors: Andreas Beck, Bochum (DE); Kay-Olaf Loock, Wolfsburg (DE); Kai Schrenke, Walbeck (DE); Willi Kammerbauer, Landershofen (DE)

(73) Assignee: Kiekert AG, Heiligenhaus (DE)

( * ) Notice: Subject to any disclaimer, the term of this patent is extended or adjusted under 35 U.S.C. 154(b) by 739 days.

(21) Appl. No.: 12/682,650

(22) PCT Filed: Oct. 4, 2008

(86) PCT No.: PCT/DE2008/001637
§ 371 (c)(1),
(2), (4) Date: May 21, 2010

(87) PCT Pub. No.: WO2009/049588
PCT Pub. Date: Apr. 23, 2009

(65) Prior Publication Data

US 2010/0236305 A1 Sep. 23, 2010

(30) Foreign Application Priority Data

Oct. 12, 2007 (DE) ..... 10 2007 049 078

(51) Int. Cl.
*E05C 3/16* (2006.01)

(52) U.S. Cl.
USPC ..... 292/216; 292/201; 292/DIG. 23

(58) Field of Classification Search
USPC ..... 292/216, 201, DIG. 23
See application file for complete search history.

(56) References Cited

U.S. PATENT DOCUMENTS

| | | | | |
|---|---|---|---|---|
| 5,150,933 | A * | 9/1992 | Myslicki et al. | 292/216 |
| 6,349,611 | B1 * | 2/2002 | Nagle et al. | 74/493 |
| 7,975,349 | B2 * | 7/2011 | Broadhead et al. | 16/346 |
| 2005/0184537 | A1 | 8/2005 | Le et al. | |

FOREIGN PATENT DOCUMENTS

| | | | |
|---|---|---|---|
| DE | 199 29 022 | A1 | 1/2001 |
| DE | 10 2005 012 419 | A1 | 9/2006 |

* cited by examiner

*Primary Examiner* — Mark Williams
(74) *Attorney, Agent, or Firm* — Renner, Otto, Boisselle & Sklar, LLP

(57) ABSTRACT

Motor vehicle lock (1) having a lock housing (2) with at least a locking mechanism (3) and actuating means (6), wherein at least one actuating means (6) extends through an opening (8) in the lock housing (2) and the opening (8) is provided with at least one reinforcing insert (9).

17 Claims, 3 Drawing Sheets

REINFORCED MOTOR VEHICLE LOCK

CROSS-REFERENCE TO RELATED APPLICATIONS

This is a National Stage Application of International Patent Application No. PCT/DE2008/001637, with an international filing date of Oct. 4, 2008, which is based on German Patent Application No. 10 2007 049 078.1, filed Oct. 12, 2007.

BACKGROUND OF THE INVENTION

1. Field of the Invention

The present invention refers to a motor vehicle lock having a lock housing with at least a locking mechanism and actuating means. The invention is applicable in particular in the area of closing systems for motor vehicle doors.

2. Brief Description of the Related Art

Such a motor vehicle lock is used for example for closing and/or opening of motor vehicle doors and there like. Because motor vehicle locks and/or components thereof are generally to be protected from dust and/or water, a closed lock housing is usually provided to accommodate the locking mechanism. A locking mechanism usually comprises a catch and at least a pawl, wherein these components are so arranged that they can receive and retain in a locked position a locking pin attached to the vehicle body. In doing so, the pawl has the function of blocking the catch in this position.

In connection herewith, it is to be considered that such locking mechanism is exposed to increased forces, in particular during a motor vehicle side impact, for example, when the external door surface is impacted against the housing resulting in a massive deformation. This can lead in extreme cases to a jammed locking mechanism when the associated motor vehicle door can only be opened with great efforts. To improve the safety of motor vehicles, it was previously proposed to use reinforcement components for the motor vehicle lock, e.g., in the form of reinforcing plates connected to the housing.

Although much progress had already been done with known motor vehicle door locks in this regard, still various crash scenarios can lead to unwanted safety limitations, in particular, when the main deformation occurs in particular areas of the motor vehicle.

BRIEF DESCRIPTION OF THE INVENTION

Starting from this premise, the present invention aims to solve the problems described above, at least in part, taking into account the state of the art. Beyond this, a motor vehicle lock is to be developed that provides in particular safety, similarly during side impacts or increased mechanical loads. In addition, the motor vehicle lock is to be economically producible and require a low cost of assembly.

The objectives are fulfilled herein by providing a motor vehicle door in accordance with the limitations of the claims. Additional features of the motor vehicle door lock are indicated in the appended dependent claims. It is to be pointed out in particular that the limitations specified separately in the claims can be combined in any number of ways that are technologically practical, as desired, to form additional embodiments of the invention. The description, taken together in particular with the figures, additionally characterizes and defines the invention.

The motor vehicle lock according to invention comprises a lock housing with at least locking mechanism and actuating means, wherein at least one actuating means extends through an opening in the lock housing, and the opening is provided with at least one reinforcing insert.

As described above in the introduction, in the locked condition of the vehicle door lock, the catch by means of a pawl, which blocks the catch, receives and retains a locking pin. In order to unlock the locking mechanism from this position, actuating means must act on the locking mechanism, which ensures a disconnection of the locking mechanism components at the desired time. These actuating means can be, for example, levers, Bowden cables, power trains, or similar equipment designed to transfer movement, force, and/or momentum. The user will initiate this actuation of the locking mechanism mostly from a place arranged far away from the motor vehicle lock, for example, originating at an external door handle and/or an internal door handle. That means, in other words, that the actuating means which connects the locking mechanism and, e.g., the door handle, also passes through the lock housing, or is fixed therein, and/or is connected thereto. The lock housing can be provided directly with an opening leading to the interior of the lock housing, or an opening for receiving the actuating means can be provided outside or inside of the lock housing. The opening can be formed in particular in the form of a recess, orifice, aperture, hole, etc., and the opening is provided in the vicinity of the lock housing and/or in the vicinity of the interior. In any event, the opening serves as a holder for the actuating means with respect to the lock housing and/or the locking mechanism components arranged therein. Thus, the opening forms in particular a point of attachment for the outer actuating means, such as, e.g., the interior operating lever and/or the external operating lever.

It is further proposed herein that the openings are provided at least with one reinforcing insert. Even if, in general, e.g., also two reinforcing inserts can be provided to (partially) restrict the opening, it is preferred for reasons of economy and as low assembly cost as possible to use one reinforcing insert per opening. In addition, not the entire inner diameter of the opening must be covered by the reinforcing insert; it suffices also that the reinforcing insert covers at least one side surface or one front surface. Although the reinforcing insert could be also provided as a type of coating, it is however preferred that the reinforcing insert is a ring and/or collar-shaped arrangement near the opening. The reinforcing insert is characterized in particular by the fact that it has increased physical properties with respect to the structure that forms the opening. Thus, in particular provided is a wear guard or break-out protection for the case of a particularly high stress, such as, e.g., in the case of a side impact.

In accordance with a further embodiment of the motor vehicle lock, it is also proposed that at least one said reinforcing insert is made from a different material than the lock housing that forms the opening. Thus, it is also considered herein to form the area of the lock housing located in the vicinity of the opening from a plastic material and to form at least one said reinforcing insert from metal. In this way, the reinforcing insert is made to have a higher wear resistance and deformation resistance.

Beyond that, it is also favorable when at least one said reinforcing insert extends into the interior of the lock housing. Thus, the reinforcing insert is provided, for example, in the form of a circular plate that forms an edge outside of the opening (partially), wherein the reinforcing insert forms a sleeve which extends over the opening and into the interior of the lock housing. Thus, it is particularly contemplated that the reinforcing insert extends into the interior of the lock housing, e.g., in order to be fixed therein and/or to perform additional functions therein.

As an additional improvement of the motor vehicle door lock, at least one said reinforcing insert is connected to the lock housing in the area of the opening using a snap-in or a snap-on connection. This results in a simple assembly of the reinforcing insert and the lock housing. For this purpose, for example, a light ductile portion of the plastic lock housing can be interlocked with the reinforcing insert. For example, shallow indentations can be formed so that a click connection or a snap-in connection (one that is also disconnectable if necessary) can be quickly and simply achieved.

In addition, it is favorable with respect to the multi-functional arrangement of such an reinforcing insert that at least one reinforcing insert forms at least one guide or bearing for at least one actuating means. It is especially particularly preferred that the reinforcing insert is implemented with bearings and a guide for each actuating means. So, for example, two fixed points for the bearing of a Bowden cable and/or a lever can be implemented, wherein the actuating means is extended between these two bearing points, if applicable. In this way, implemented is a particularly resilient and accurate guide for the lock housing components by means of the reinforcing insert, wherein improving the functional safety and at the same time also crash-resistance. For the sake of completeness only, it is pointed out that the bearing and/or guide is naturally implemented with further, and if necessary separate, components, in particular with bushes, seals and the like.

As an additional improvement of the motor vehicle door lock, at least one said reinforcing insert is provided with a reinforcement plate that stretches between the lock housing and the locking mechanism. In this case, not only is the operational safety of the actuating means at the place of entry into the motor vehicle lock improved, but also at the same time the integration of the reinforcing insert and the above-mentioned reinforcing plates ensured. Accordingly, while the operational safety is increased, the number of parts that is necessary to produce said crash-protected motor vehicle lock is retained at the same level. In addition, the mostly relatively rigid integration of the reinforcing plate provides a rigid alignment of the reinforcing insert in the area of the opening and with this provides also a practically-almost invariable pivot point for the actuating means at the lock housing. In this way, a low-friction, fast and accurate actuation can be ensured even after a large number of actuations.

In view of the preferred area of application of the invention, provided is also a motor vehicle, comprising at least the vehicle door lock described herein The motor vehicle referred to is in particular a passenger car or a truck.

BRIEF DESCRIPTION OF THE DRAWINGS

The invention as well as the background art is described below with reference to the drawings. It is to be pointed out that the figures indicate particularly preferred embodiments of the invention, but the invention is not limited thereto. In the schematic drawings.

DETAILED DESCRIPTION OF THE INVENTION

Figure 1:
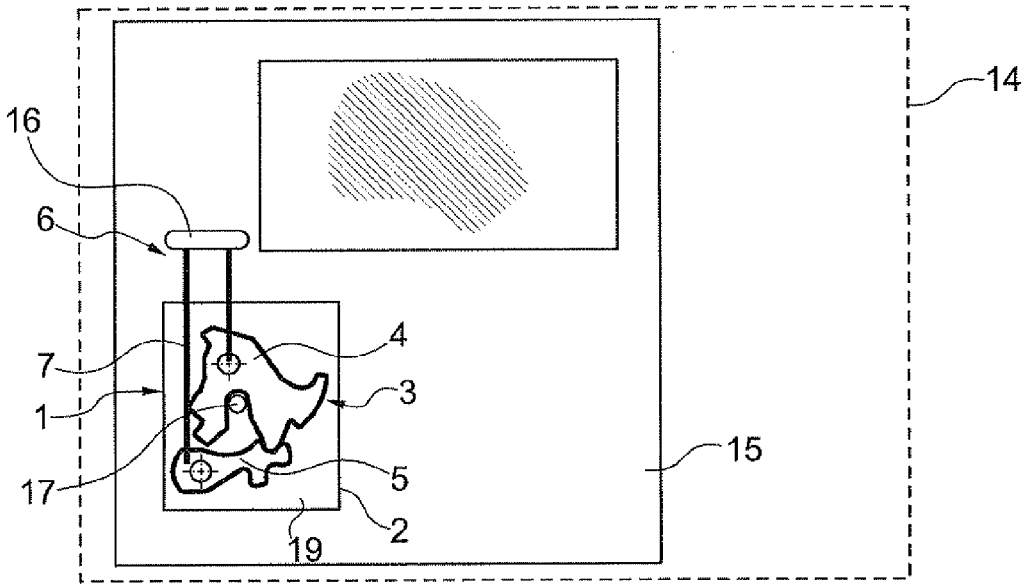
FIG. 1 shows a representation of a motor vehicle with a motor vehicle lock.

FIG. 1 illustrates schematically a motor vehicle 14 with a door 15 implemented with a motor vehicle lock 1. As is known, such a motor vehicle lock 1 can be actuated, for example, via a door handle 16 attached to the door 15, wherein the actuation request or the actuation action is transferred by the actuating means 6 to locking mechanism 3. The actuating means 6 can also be implemented as levers. Here, shown are as example only Bowden cables 7.

The actuating means 6 extend now into the interior 19 of the lock housing 2. In the lock housing 2 arranged is the locking mechanism 3, which comprises a catch 4 and a pawl 5. In the illustrated position, the catch 4 receives and retains a locking pin 17 attached to the body and is blocked by means of the pawl 5. It can be guessed, how important it is that neither the function of the actuating means 6 nor the function of the locking mechanism 3 are impaired by an excessive load, i.e., if the need arises to free accident survivors from the outside through the door 15.

Figure 2:
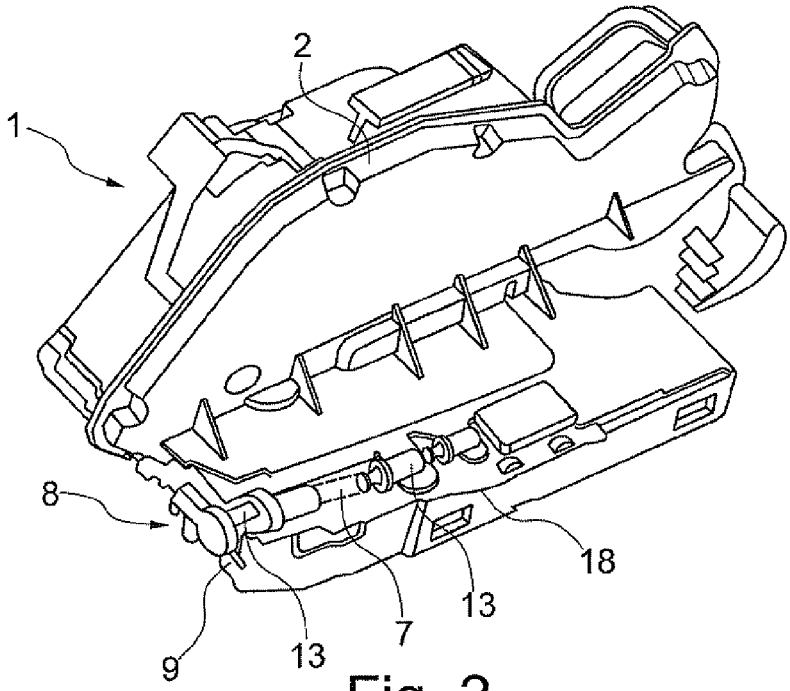
FIG. 2 shows a perspective of a motor vehicle lock from the outside.

FIG. 2 illustrates an embodiment of the motor vehicle lock 1 in a perspective representation with an encapsulated lock housing 2 shown. In the lower right area of the motor vehicle lock 1 provided is an opening 8, in which a Bowden cable 7 is fixed. The Bowden cable 7 passes through the bearing 13. The opening 8 is disposed in a part of the lock housing 2 made from plastic. The bearing 13 is inserted in the U-shaped and/or omega-shaped opening 8, and a reinforcing insert 9 provided in said opening ensures that the bearing 13 stays fixed despite strong impact forces. The reinforcing insert 9 is connected with the reinforcing plate 18. The reinforcing plate 18 extends not only outside of the lock housing but also into the inner areas of the motor vehicle lock.

Figure 3:
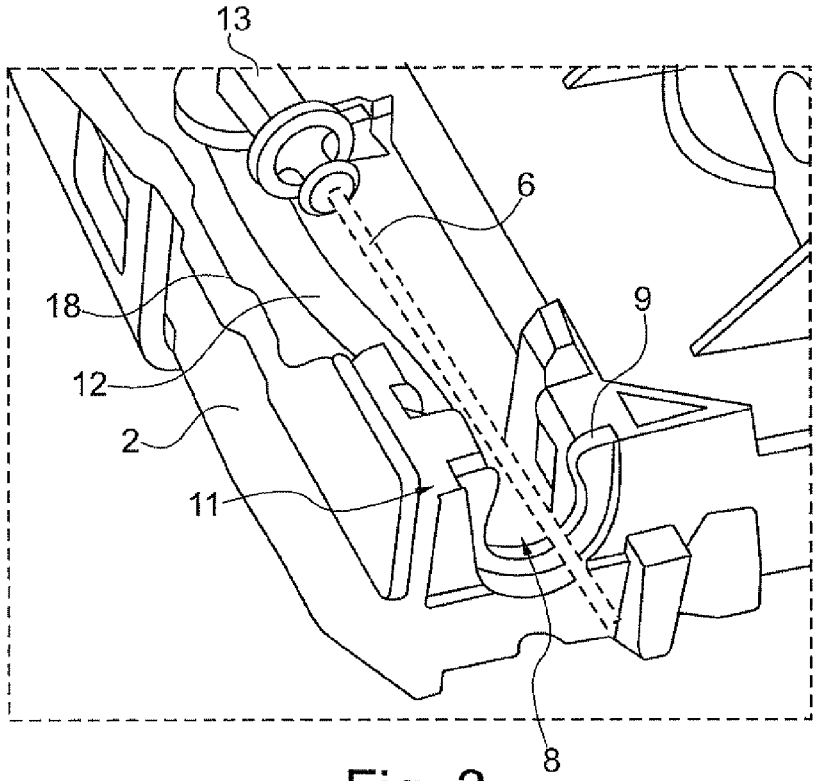
FIG. 3 shows a detail of a motor vehicle lock with a reinforced seat for the actuating means.

The FIG. 3 shows again a perspective view of an embodiment of the actuating means 6 with the lock housing 2. In the front of the illustrated area shown is again a (not closed) opening 8 or a seat for the actuating means 6. During normal operation, the actuating means 6 is moved, for example, in the extending direction of the means forwards and backwards and is acted upon with a suitable force. The opening 8 can be, therefore, exposed to particularly high forces, either due to a high continuous stresses and/or an excessively high force.

In order to ensure a permanent and accurate fixation in the lock housing, provided is a reinforcing insert 9 at the front side of the opening 8 extending outward. The reinforcing insert 9 forms essentially a similar opening or seat for the actuation means 6. In order to realize a stable operational connection between the lock housing 2 and the reinforcing insert 9, the two are joined together using a snap-in connection 11.

The reinforcing insert 9 is also in this case not only provided in the area of the opening 8, but it extends up to the additional bearings 13 for the actuating means 6. In the area where a connection is formed between the opening 8 and the bearing 13 provided is a surface, even a guide 12, for the actuating means 6. The reinforcing plate 18, made in particular from metal, forms a reinforcing insert 9 and at the same time, is characterized by a particularly high robustness and deformation rigidity so that the functionality of the actuating means 6 can be ensured in many cases.

Figure 4:
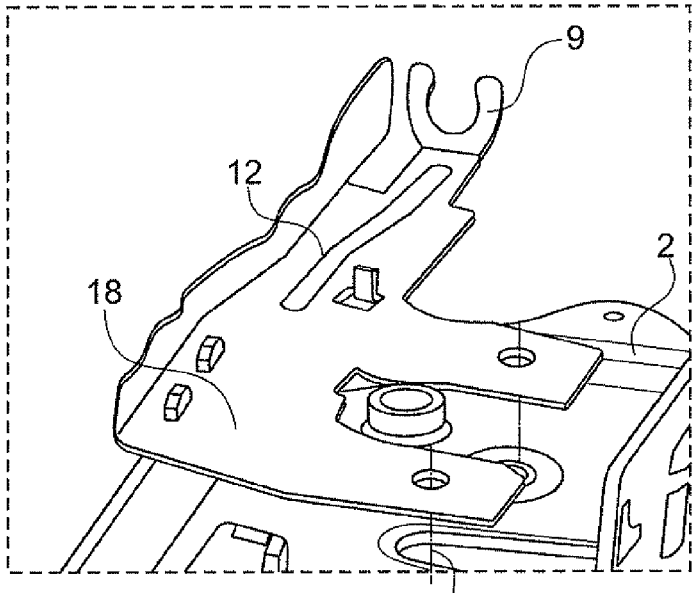
FIG. 4 shows an embodiment of a reinforcing plate with a reinforcing insert.

FIG. 4 shows a perspective view of an embodiment of a reinforcing plate 18, wherein the reinforcing plate 18 is formed as a sleeve-shaped extension of the omega-shaped reinforcing insert 9 for insertion into the opening 8. At the same time, it is to be recognized that the reinforcement plate 18 extends into the internal areas of the lock housing 2, especially also over the rotation axis 20 of the locking mechanism 3 in order to protect locking mechanism 3 (not shown) in the event of a side impact.

Figure 5:
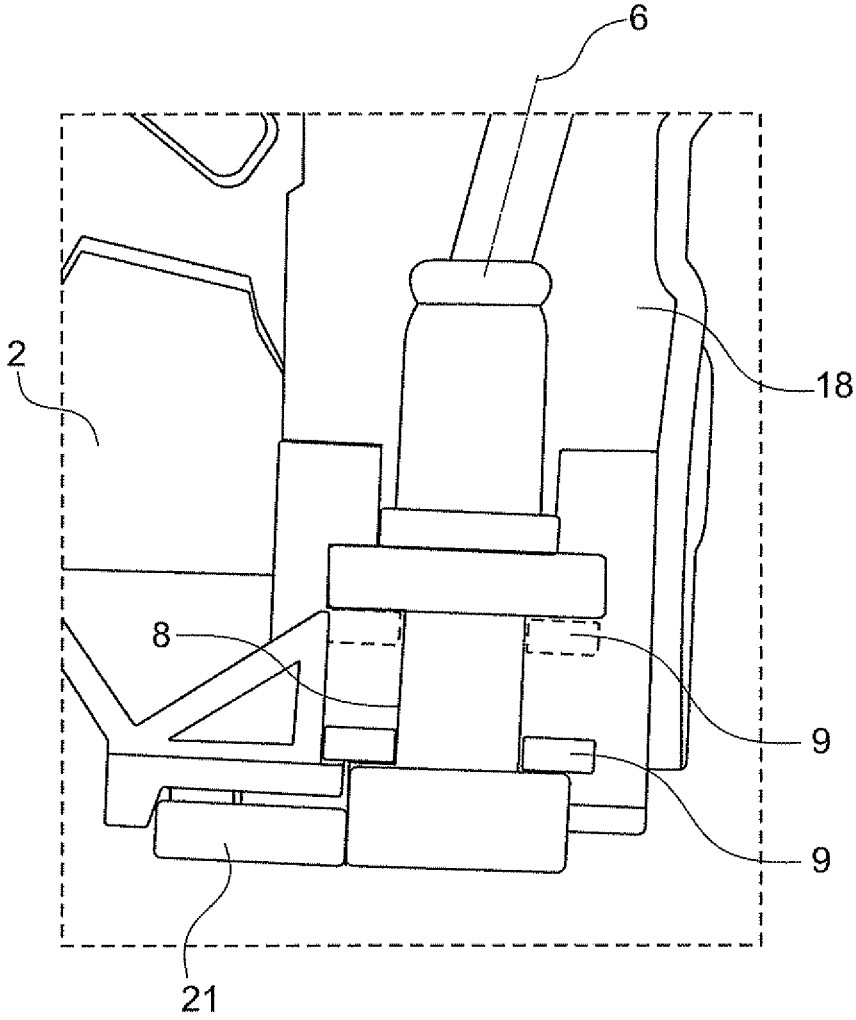
FIG. 5 shows a detail of a further embodiment of a motor vehicle lock with reinforced opening for an actuating means.

FIG. 5 shows as plan view an additional embodiment of the seat for the actuating means 6 with an opening 8 and the reinforcing insert 9. Also in this example, the reinforcing insert 9 is connected with the reinforcement plate 18 forming a single piece. The opening 8 and/or the reinforcing insert 9 serves here in particular as a seat for a bushing 21, which serves as a bedding for the actuating means 6 (only implied in the drawing). The bushing 21 can extend in particular at both sides of the opening 8, wherein, if necessary, a separate reinforcing insert 9 is also disposed on the opposite front surface, as indicated by the broken lines.

LIST OF REFERENCE SYMBOLS

1. Motor vehicle lock
2. Lock housing
3. Locking mechanism
4. Catch
5. Pawl
6. Actuating means
7. Bowden cable
8. Opening
9. Reinforcing insert
10. Interior
11. Snap-in connection
12. Guide
13. Bearing
14. Motor vehicle
15. Door
16. Door handle
17. Locking pin
18. Reinforcing plate
19. Interior
20. Rotation axis
21. Bushing

The invention claimed is:

1. A motor vehicle lock comprising:
a lock housing;
a locking mechanism arranged in the lock housing;
an actuating member extending through an opening in the lock housing for connection to the locking mechanism;
a bearing which guides the actuating member for movement through the opening in the lock housing; and
a reinforcing insert supported by the lock housing, the reinforcing insert being made of a material different than a material of the lock housing, the material of the reinforcing insert having higher rigidity as compared to the material of the lock housing, and the reinforcing insert for supporting the bearing in the lock housing;
wherein the reinforcing insert extends over the opening and into the interior of the lock housing.

2. The motor vehicle lock of claim 1, wherein said reinforcing insert forms a snap-in connection with said lock housing in the vicinity of said opening.

3. The motor vehicle lock of claim 1, wherein said reinforcing insert has a guide for said actuating member within the interior of the lock housing.

4. The motor vehicle lock of claim 1, wherein said reinforcing insert is formed with a reinforcing plate, said reinforcing plate extending between said lock housing and said locking mechanism, wherein the reinforcing plate extends into the lock housing and over a rotation axis of the locking mechanism.

5. A motor vehicle comprising at least a motor vehicle lock of claim 1.

6. The motor vehicle lock of claim 4, wherein said reinforcing insert forms a snap-in connection with said lock housing in the vicinity of said opening.

7. The motor vehicle lock of claim 5, wherein said reinforcing insert forms a snap-in connection with said lock housing in the vicinity of said opening.

8. The motor vehicle lock of claim 2, wherein said reinforcing insert has a guide for said actuating member within the interior of the lock housing.

9. The motor vehicle lock of claim 4, wherein said reinforcing insert has a guide for said actuating member within the interior of the lock housing.

10. The motor vehicle lock of claim 5, wherein said reinforcing insert has a guide for said actuating member within the interior of the lock housing.

11. The motor vehicle lock of claim 6, wherein said reinforcing insert has a guide for said actuating member within the interior of the lock housing.

12. The motor vehicle lock of claim 7, wherein said reinforcing insert has a guide for said actuating member within the interior of the lock housing.

13. The motor vehicle lock of claim 2, wherein said reinforcing insert is formed with a reinforcing plate, said reinforcing plate extending between said lock housing and said locking mechanism, wherein the reinforcing plate extends into the lock housing and over a rotation axis of the locking mechanism.

14. The motor vehicle lock of claim 5, wherein said reinforcing insert is formed with a reinforcing plate, said reinforcing plate extending between said lock housing and said locking mechanism, wherein the reinforcing plate extends into the lock housing and over a rotation axis of the locking mechanism.

15. The motor vehicle lock of claim 7, wherein said reinforcing insert is formed with a reinforcing plate, said reinforcing plate extending between said lock housing and said locking mechanism, wherein the reinforcing plate extends into the lock housing and over a rotation axis of the locking mechanism.

16. The motor vehicle lock of claim 10, wherein said reinforcing insert is formed with a reinforcing plate, said reinforcing plate extending between said lock housing and said locking mechanism, wherein the reinforcing plate extends into the lock housing and over a rotation axis of the locking mechanism.

17. The motor vehicle lock of claim 12, wherein said reinforcing insert is formed with a reinforcing plate, said reinforcing plate extending between said lock housing and said locking mechanism, wherein the reinforcing plate extends into the lock housing and over a rotation axis of the locking mechanism.

* * * * *